US008875327B2

(12) United States Patent
Gilley et al.

(10) Patent No.: US 8,875,327 B2
(45) Date of Patent: Nov. 4, 2014

(54) LIGHTWEIGHT PORTABLE PELVIC EXAM DEVICE

(75) Inventors: Pamela Gilley, Winter Garden, FL (US); Antonio Gandia Tapia, Maitland, FL (US)

(73) Assignee: Schnell Medical, LLC, Winter Garden, FL (US)

( * ) Notice: Subject to any disclaimer, the term of this patent is extended or adjusted under 35 U.S.C. 154(b) by 420 days.

(21) Appl. No.: 13/049,099

(22) Filed: Mar. 16, 2011

(65) Prior Publication Data

US 2011/0306901 A1 Dec. 15, 2011

Related U.S. Application Data

(60) Provisional application No. 61/354,784, filed on Jun. 15, 2010.

(51) Int. Cl.
*A61G 13/12* (2006.01)
*A61G 13/00* (2006.01)
*A61G 7/065* (2006.01)

(52) U.S. Cl.
CPC ..... *A61G 13/0009* (2013.01); *A61G 7/065* (2013.01)
USPC ..... 5/602; 5/612; 5/648; 5/649; 5/624

(58) Field of Classification Search
USPC ..... 5/602, 648, 649, 651, 621, 624, 612, 5/619
See application file for complete search history.

(56) References Cited

U.S. PATENT DOCUMENTS 2,351,849 A * 6/1944 Wells et al. ..... 4/520
3,449,771 A * 6/1969 Watson ..... 4/515
3,853,121 A * 12/1974 Mizrachy et al. ..... 601/48
3,907,270 A * 9/1975 Ezzo ..... 5/648
4,139,916 A * 2/1979 Alford, Sr. ..... 5/2.1
4,180,062 A * 12/1979 Alberti et al. ..... 600/511
4,221,370 A * 9/1980 Redwine ..... 5/613
4,340,985 A * 7/1982 Potter ..... 5/636
4,627,423 A * 12/1986 Kampner ..... 602/35
4,678,171 A * 7/1987 Sanders et al. ..... 5/618
5,249,318 A * 10/1993 Loadsman ..... 5/710
5,337,427 A * 8/1994 Pagano et al. ..... 5/602

(Continued)

OTHER PUBLICATIONS

Petrosky, Joseph E., et al., Portable Pelvic Examination Table—Improving Maternal Health Care in Rural Ghana, Apr. 21, 2009, University of Michigan, ME 450 Section 5, All Pages.*

*Primary Examiner* — William Kelleher
*Assistant Examiner* — David R Hare
(74) *Attorney, Agent, or Firm* — Antonio G Tapia

(57) ABSTRACT

A new and useful portable pelvic exam device is provided, which is lightweight for convenient transport or storage, and is readily used atop existing surfaces in the environment such as a bed and maintains a patient in a dorsal or modified lithotic position for a pelvic examination or procedure. The device comprises a substantially wedge shaped prismatic base with a concave semispherical well along the front surface, over which a patient orients her vulva to create a theatre in which the examiner may observe the anatomy, operate ancillary tools and perform an indicated procedure or exam. Stirrup assemblies may be utilized in concert with the device to support the patient's feet and keep her knees spaced apart from each other and legs in an abducted position. Additionally, the device has a drawer moveably attached into an aperature in the device, which can be opened or closed and houses therein ancillary tools.

29 Claims, 4 Drawing Sheets

(56) References Cited

U.S. PATENT DOCUMENTS

| | | | | |
|---|---|---|---|---|
| 5,375,276 | A * | 12/1994 | Nelson et al. | 5/620 |
| 5,440,770 | A * | 8/1995 | Nichols | 5/655 |
| 5,476,105 | A * | 12/1995 | Toth | 5/648 |
| 5,548,853 | A * | 8/1996 | Johnson | 4/523 |
| 6,226,821 | B1 * | 5/2001 | Heimbrock et al. | 5/690 |
| 6,230,350 | B1 * | 5/2001 | Goldstein | 5/638 |
| 6,256,817 | B1 * | 7/2001 | McGuire et al. | 5/619 |
| 6,360,387 | B1 * | 3/2002 | Everhart | 5/630 |
| 6,553,995 | B1 * | 4/2003 | Cole et al. | 128/846 |
| 6,698,044 | B2 * | 3/2004 | Limpert et al. | 5/624 |
| 6,704,957 | B2 * | 3/2004 | Rhodes | 5/637 |
| 7,228,579 | B2 * | 6/2007 | Tidwell | 5/624 |
| 8,382,692 | B1 * | 2/2013 | Chao | 602/18 |
| 2009/0179533 | A1 * | 7/2009 | Bochner et al. | 312/209 |
| 2009/0222992 | A1 * | 9/2009 | Loewenthal et al. | 5/653 |
| 2013/0160211 | A1 * | 6/2013 | Klein et al. | 5/648 |

* cited by examiner

LIGHTWEIGHT PORTABLE PELVIC EXAM DEVICE

CROSS-REFERENCE TO RELATED APPLICATIONS

This Application claims the benefit of U.S. Provisional Application No. 61/354,784, filing date Jun. 15, 2010.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

TECHNICAL FIELD

The present invention is in the technical field of medical devices. More particularly, the present invention is in the technical field of exam tables. More particularly, the present invention is in the technical field of portable exam tables.

BACKGROUND OF THE INVENTION

OB/GYN examinations are usually conducted with the patient lying supine in either a dorsal or modified lithotomy position on a dedicated pelvic examination table. The currently used examination tables are generally large, heavy, and designed to be kept in a fixed location. They are not easily transported from location to location; the immobile character of pelvic examination tables requires that patients be moved to the dedicated exam room and onto the table.

In the applicant's experience there is a deficiency in the existing and prior art wherein there are no lightweight portable pelvic exam tables or devices that can be carried from exam room to exam room and used easily in concert with existing hospital beds, exam tables or furniture.

In the applicant's experience, oftentimes gynecological examinations must be performed when a proper gynecological exam table is not available. In some cases, pillows or bedpans are used to elevate the patient's buttocks to simulate the lithotomy position. This is often uncomfortable for the patient and many times non-hygienic. Further the use of stacked rigid objects such as bedpans creates a safety hazard as the weight of the patient may cause the items to shift, dislodge or collapse. Without a gynecological exam table and without resorting to the aforementioned unsafe and possibly-septic options, the examiner must attempt to perform a pelvic exam while the patient is on a flat examination table or bed. This maintains the patient in a flat, supine orientation which makes the pelvic exam difficult or impossible to perform. Without the patient in a dorsal or modified lithotomy position, the examiner encounters more difficulty to view the anatomy of the patient and maintain and use the accompanying devices—speculums, swabs, lights, etc.—in a fashion that is comfortable for the patient and effective for the indicated procedure.

Although wheeled portable pelvic exam carts exist, they are still very large, heavy—approximately one-half the size of a medical bed—and expensive. Portable pelvic exam carts resemble small beds, and are moved on wheels from room to room. They are reportedly uncomfortable for the patient and practitioner to use. Also, because they are quite expensive, it makes it unlikely that a medical center or hospital to have more than one.

There is an OB/GYN chair disclosed in U.S. Pat. No. 6,256,817. The chair disclosed in the patent is collapsible, intended to be mobile and is essentially a reclining folding chair. However, the chair is still a dedicated and bulky option. It is not intended to be used on top of an existing bed or table upon which the patient may already be laying. The chair still requires the patient to move from a bed and onto the dedicated device. This does not solve the problem posed by patients who are immobile. The chair also requires manipulation in order to unfold the chair and properly engage it for use. This requires extra steps before the device can be used, and can impose a safety hazard if it is not assembled correctly prior to use. Furthermore, this chair, when in use by a patient, holds her in a reclining position only a few feet from the ground—approximately the height of the seat of the chair. If this chair is used, the examiner would have to kneel or squat to perform the procedure. Overall this chair does not seem to address portability, ease of use and patient mobility in a similar manner as the present invention.

In the applicant's experience, there is a need for an OB/GYN examination device which is i) light-weight, ii) easily transportable by one person to the patient, iii) can be used on existing beds or tables, iv) is adapted to house necessary tools for examination procedures, v) requires little or no assembly prior to use and vi) is comfortable and safe for the patient. The device of the present invention is believed to accomplish all of the foregoing objectives.

SUMMARY OF THE INVENTION

The present invention provides a new and useful portable pelvic exam device which is lightweight, easily transportable and can be used on existing beds or tables to support an OB/GYN patient in a dorsal or modified lithotomy position for examination or procedure. This device is believed to be useful in hospitals and clinics, wherein OB/GYN examinations may need to be performed, wherein few or no full-size, dedicated pelvic exam tables are available, or in environments where budget or space restrictions require a more frugal or temporary option. A device according to the invention is also believed to be favorable for use with immobile patients or in emergency situations.

In one of its basic embodiments, the present invention comprises a substantially wedge shaped prismatic base having a top surface, bottom surface, a plurality of side surfaces, wherein the top surface and bottom surface are angularly disposed to create an incline that supports the patient in a dorsal or modified lithotomy position. A cushion is demountably attached to the top surface of the prismatic base. A semispherical concave well is located approximately in the center of an edge formed at the nexus of the top surface and the front surface of the base and is defined by the edges of a curve cut into the cushion, the top surface and front surface of the prismatic base. The prismatic base can be made primarily of plastic or one or more other strong, light weight materials such as rigid polyvinyl chloride (PVC).

In another embodiment of the present invention, the device further comprises a drawer that is retractably mounted into an aperature in the front surface of the prismatic base and has a face plate, left side wall, right side wall, back wall and floor. The drawer is arranged to be withdrawn from the front side surface of the prismatic base by the user exerting a pulling force and inserted by the user exerting a pushing force. A handle, lock and moveable partitions may also add functionality to the drawer.

In another embodiment of the present invention, the device further comprises a pair of removable stirrup assemblies pivotally mounted to the left surface and the right surface of the prismatic base by receiving adapters for mated fitting with the stirrup assemblies.

When the device is used in an examination, the device is placed on the superior surface of an existing examination table or bed. The front surface of the device aligns substantially parallel to the foot of the bed and enables a patient to be supported in a position suitable for an OB/GYN examination. The patient lays on the bed and places her lower body and pelvis upon the cushion attached to the prismatic base. The device provides support for the lower lumbar and pelvic portions of the patient's body and acts to elevate the pelvis upwardly from the bed or table surface. The patient's perineum is aligned and flush with the front surface of the device and presents itself above the semispherical concave well along the anterior edge of the device—created at the nexus of the top surface and front surface of the device—and creates a theater for the practitioner to conduct the examination. The patient legs are bent and the feet are either supported by placing the feet on the superior surface of the bed, or on stirrup assemblies optionally attached to the prismatic base. The patient's hips and legs are flexed and thighs apart. The examiner then can position themselves to face the examination theater created by the well and perineum.

In another embodiment of the invention, prior to placement of the patient thereupon, the examiner uses an attaching means such as straps to affix the device to an existing examination table or bed.

Thus the present invention is believed to provide a new and useful device which is light weight, portable, can be used on existing beds or tables, and is comfortable and safe for the patient. Typical situations and settings that would benefit from the availability of a portable and far less expensive device than traditional pelvic examination tables would be: small clinics, medical facilities with limited dedicated pelvic exam tables, facilities that deal with immobile patients, facilities that have space or budgetary considerations that prohibit the use of existing pelvic exam tables. Settings where transportability is essential, for example military field hospitals and remote third world clinics would also benefit from the present invention.

Further features and objectives of the present invention will become apparent form the following detailed description and the accompanying drawings.

DETAILED DESCRIPTION OF THE INVENTION

Figure 1:
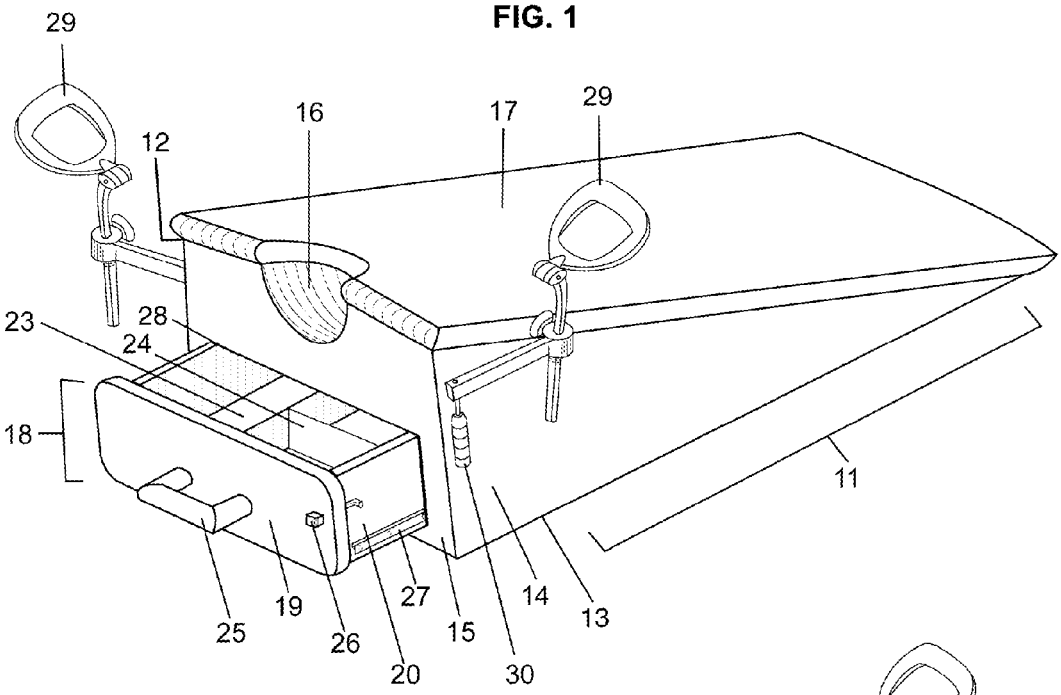
FIG. 1 is a perspective view of a lightweight portable pelvic exam device according to the present invention.
Figure 2:
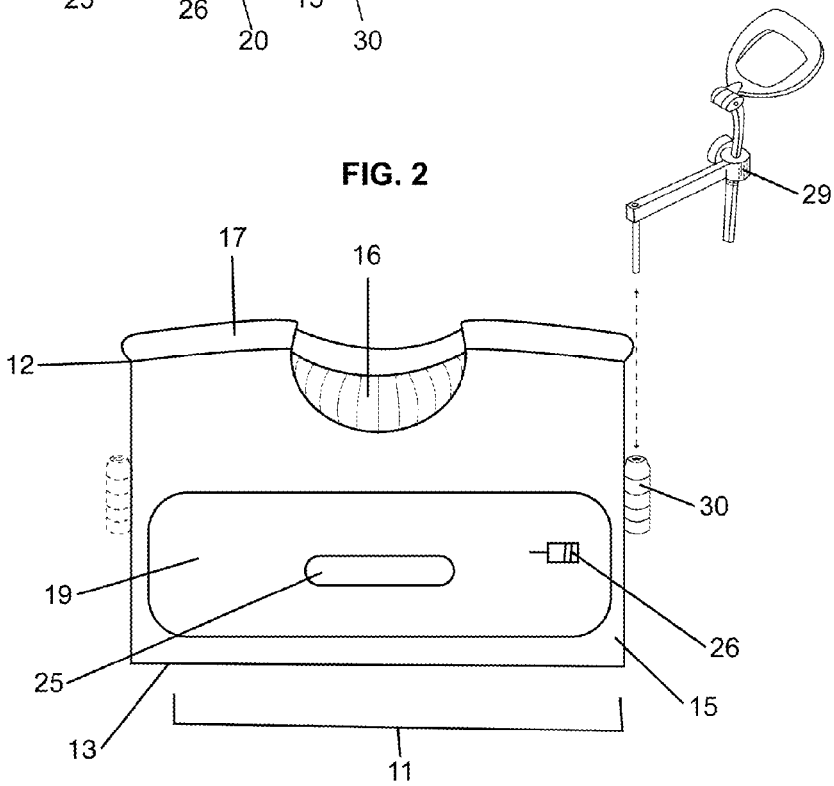
FIG. 2 is a front elevation view of the device.
Figure 3:
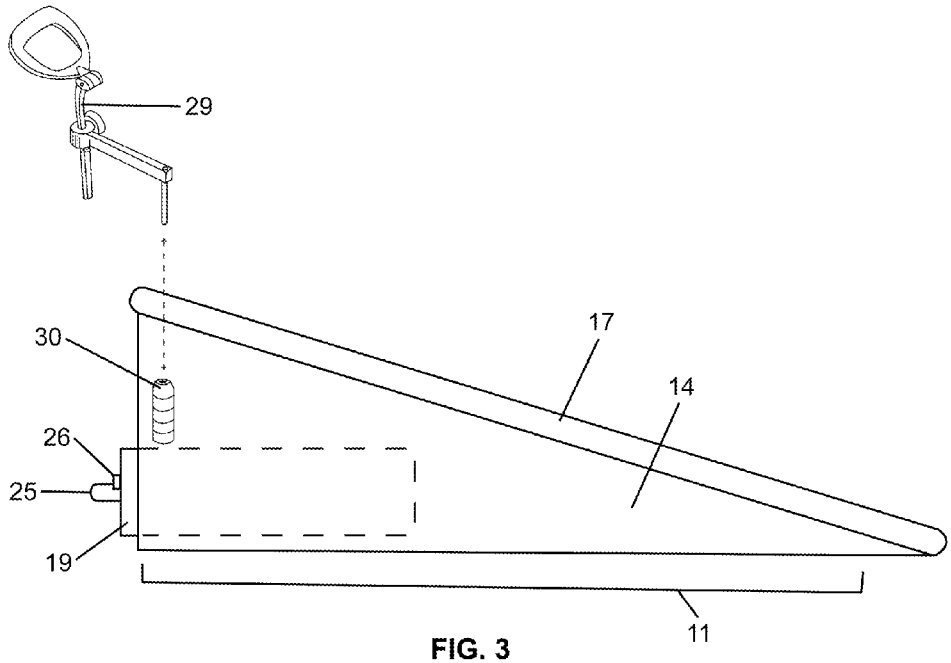
FIG. 3 is a side elevation view of the device.
Figure 4:
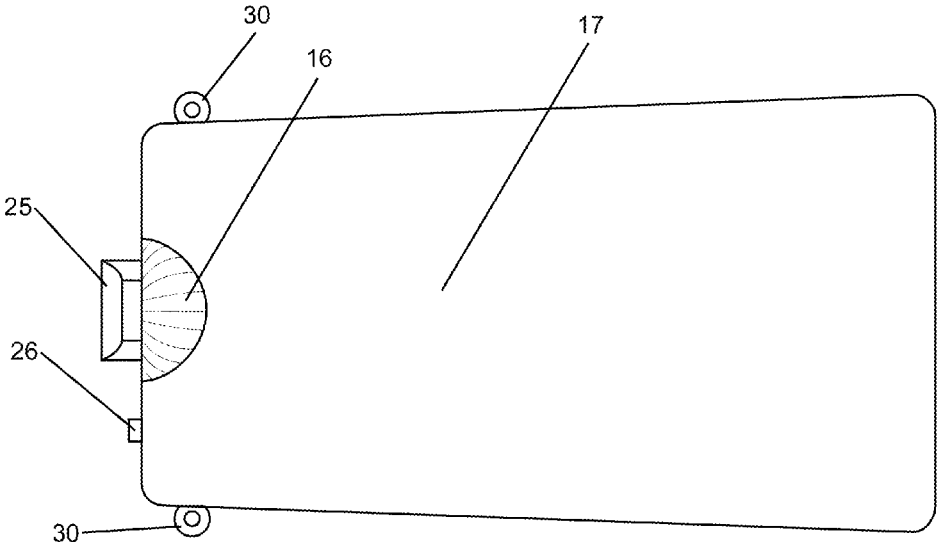
FIG. 4 is a top view of the device.

As described above, the present invention provides a new and useful portable pelvic exam device which is lightweight, easily transportable and can be used on existing beds or tables to support an OB/GYN patient in a dorsal or modified lithotomy position for examination or procedure. This device is believed to be useful in hospitals and clinics, wherein OB/GYN examinations may need to be performed, wherein few or no full-size, dedicated pelvic exam tables are available, or in environments where budget or space restrictions require a more frugal or temporary option. A device according to the invention is also believed to be favorable for use with immobile patients or in emergency situations. The following description and accompanying drawings disclose at least one version of such a device.

Referring now to the invention in more detail, in FIG. 1 to FIG. 4 there is shown a portable lightweight pelvic exam device comprising a prismatic base 11 having top surface 12, a bottom surface 13, a plurality of side surfaces 14 and a front surface 15. A concave semispherical well 16 is formed at an edge formed by the nexus of the top surface 12 and the front surface 15 and is approximately located in the center of the front surface, centered along the longitudinal axis of the device. A cushion 17 is removeably attached to the top surface of the device. A drawer 18 is mounted into an aperature 28 in the front surface 13 of the device. The drawer is itself comprised of a face plate 19, a plurality of side walls 20, a back wall 21 and a floor 22. The interior of the drawer optionally contains a plurality of interior compartments 23, as defined by a plurality of dividers 24, to hold ancillary tools. The drawer face plate 19 further has a handle 25 and a lock 26. The drawer in toto is mounted to the prismatic base on sliding rails 27. The device also has a plurality of receiving adapters 30 mounted to the device for mated fitting with ancillary tools or stirrup assemblies 29.

In more detail, still referring to the invention of FIG. 1 to FIG. 4, the top surface 12 and the bottom surface 13 are angularly disposed to create an incline upon which a patient can be supported in a dorsal or modified lithotomy position. To conduct an examination, the device is transported to an examining room or area. The device is placed on an existing supporting surface, for example a bed or table. The front surface 15 of the device is aligned substantially near and parallel to an edge of the underlying supporting surface, bed or table. Stirrup assemblies 29 are pivotally attached to receiving adapters 30 that are attached to the side surfaces 14 of the device. A patient is then presented onto the device lying with her back on the removeably attached cushion 17. A portion of her body may also be supported by the underlying supporting surface. Her vulva or pelvic floor is aligned with the upper edge of the front surface 15, and presents above the semispherical concave well 16 to create a theater within which the examiner may conduct an examination, manipulate tools and observe the anatomy. The patient's feet are placed in the stirrup assemblies 29 which have been previously adjusted to fit the patient. Throughout the examination, the feet remain in the stirrup assemblies 29 and the legs in an abducted position, knees apart from each other, to maximize access and visibility for the examiner. The examiner, when seated between the patient's legs or oriented to face the front surface 15, the semispherical concave well 16 and the anatomy of the patient, may optionally open the drawer 18 that is mounted on rails 27 to an aperature 28 in the front surface 15 of the device. The examiner does this by unlocking the drawer lock 26 and exerting a pulling force on the handle 25 that is mounted to the face plate 19 of the drawer 18. The examiner then may withdraw indicated ancillary tools from interior compartments 23 that are in the drawer 18 and formed by a plurality of dividers 24. The examiner may close the drawer 18 again by exerting a pushing force on the handle 25 that is mounted on the face plate 19. With the patient presented atop the device and indicated tools in hand, the examiner then may conduct a pelvic exam or other procedure with aid of the device. When the examination is done, the patient dismounts the device, the examiner secures the drawer 18, optionally removes the stirrup assemblies 29 and transports the device to the next area of use or storage.

In further detail, still referring to the invention of FIG. 1 to FIG. 4, the dimensions of the top surface 12 of the device are sufficiently wide and long to comfortably support a patient reclining upon it. The dimensions of the top surface can be any size but is envisioned to be about 12 to 48 inches long along the longitudinal axis and 12 to 36 inches wide along a horizontal axis between more than one side surface 14. The top surface 12 and the removeably attached cushion 17 thereon comfortably support the patient's pelvis and hips in a position aligned with the horizontal edge formed at a nexus between the front surface 15 and the top surface 12. The cushion 17 can be affixed to the top surface 12 of the prismatic base 11 by hook and loop tape, screws, clips, straps or any existing equivalent. The length of the top surface 12 is envisioned to be a length that maximizes portability of the device, and comfort and stability for the patient. An envisioned embodiment of the invention supports only the pelvis and hips of the patient, while other embodiments of the device may provide support along the entire spine of the patient.

The patient's perineum, vulva or pelvic floor is supported above the semispherical well 16. The dimensions of the front surface 15, height and width, can be any measure, but preferably within the range of 1 inch to 36 inches. One embodiment of the invention has a front surface whose height is 10 inches, thereby lifting the patient's perineum, and hips 10 inches above the surface of the underlying supporting surface, table or bed.

The top surface 12 and bottom surface 13 of the prismatic base are angularly disposed to create an incline that maintains the patient in a dorsal or modified lithotomy position. This angle of incline depends on the dimensions of the top surface 12 and the front surface 15. The angle of incline can measure any degrees, but is preferably within a range of 0 to 90 degrees.

The drawer can be any size, but is preferable to be smaller in dimension than the corresponding front surface 15 within which the drawer is mounted. The aperature 28 is preferably marginally larger than the inserted drawer 18.

A plurality of receiving adapters 30 are attached to the side surfaces 14 of the prismatic base 11. These receiving adapters 30 are used for mated fitting with the stirrup assemblies 29 or ancillary tools, including lights, clips, arms, instruments or any existing equivalent.

The construction details of the invention as shown in FIGS. 1 to 4 are that the prismatic base 11 may be made of plastic or any other rigid, strong yet lightweight material. It is envisioned that the cushion 17 may be made of rubberized foam or any other material that is flexible and is comfortable for the patient to present herself upon. It is preferable, but not a necessary feature, that the cushion 17 be covered in a non-porous and easily-cleaned material such as plastic or vinyl. Further the remaining components of the invention, including the lock 26, the rails 27, stirrup assemblies 29, handle 25 and receiving adapters 30 can be made of metal or any other rigid and strong material.

Figure 5:
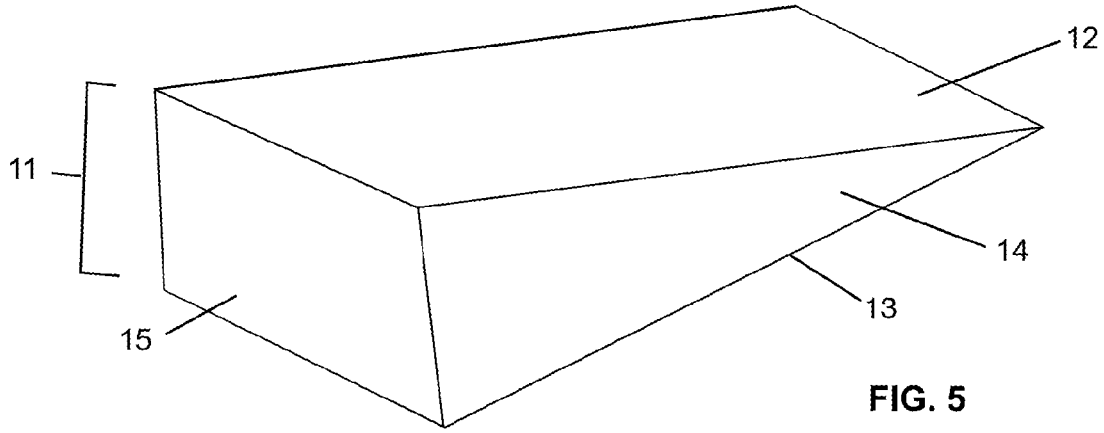
FIG. 5 is a perspective view of an alternate embodiment of the device.
Figure 6:
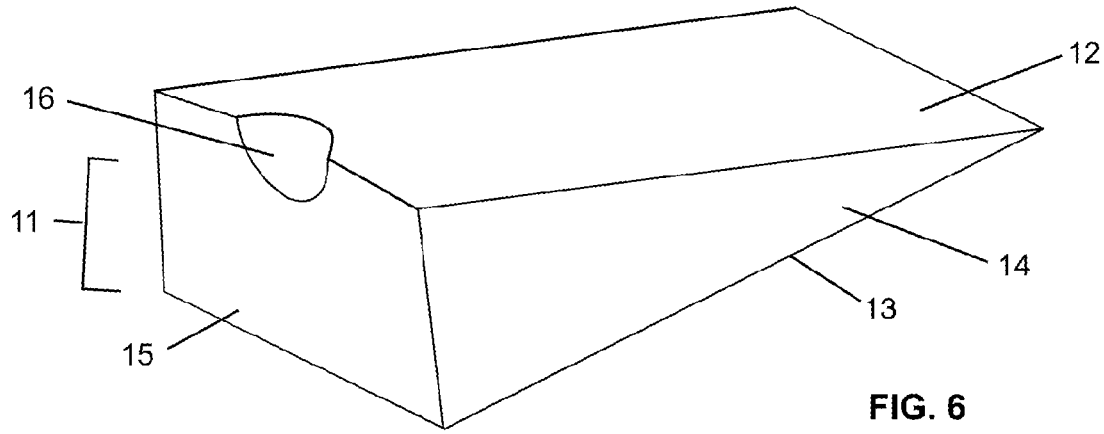
FIG. 6 is a perspective view of an alternate embodiment of the device.
Figure 7:
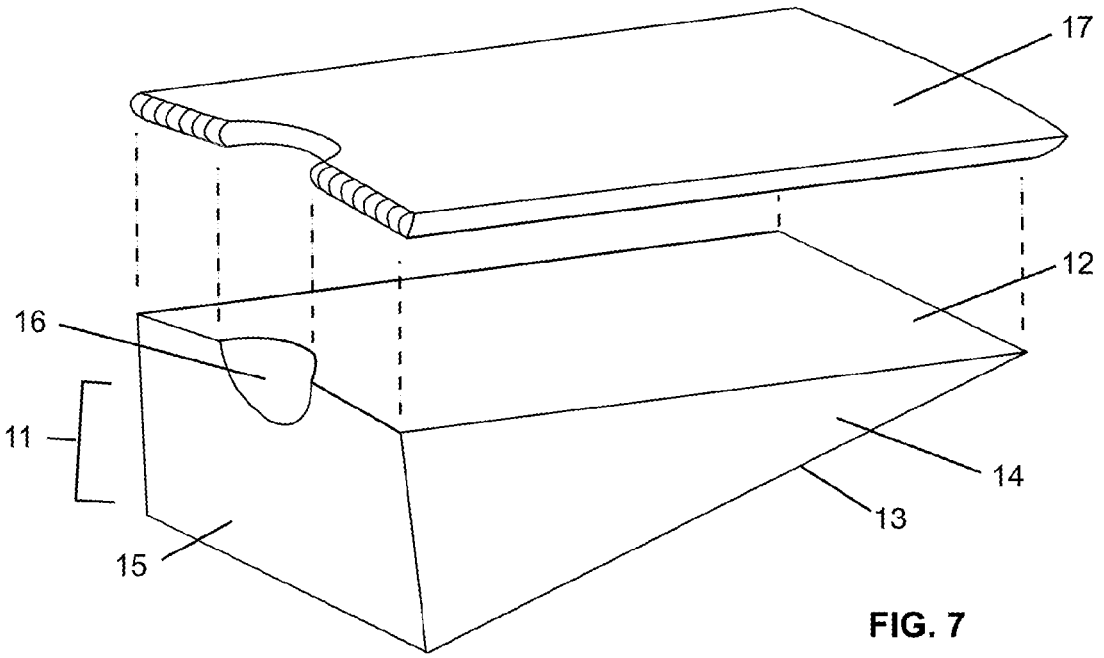
FIG. 7 is an exploded view of an alternate embodiment of the device.

Referring now to the invention, in FIG. 5 to FIG. 7 there are shown more rudimentary embodiments of a portable lightweight pelvic exam device. In FIG. 5, the device comprises a prismatic base 11 having top surface 12, a bottom surface 13, a plurality of side surfaces 14 and a front surface 15. FIG. 6 represents an embodiment of the invention as in FIG. 5 further comprising a concave semispherical well 16 located at an edge formed by the nexus of the top surface 12 and the front surface 15 and is approximately located in the center of the front surface, centered along the longitudinal axis of the device. FIG. 7 represents an embodiment of the invention as in FIG. 6 further comprising a cushion 17 which is removeably attached to the top surface 12 of the device.

In more detail, still referring to the invention of FIG. 5 to FIG. 7, the top surface 12 and the bottom surface 13 are angularly disposed to create an incline upon which a patient can be supported in a dorsal or modified lithotomy position. To conduct an examination, the device is transported to an examining room or area. The device is placed on an existing supporting surface in the environment, for example a bed or table. The front surface 15 of the device is aligned substantially near and parallel to an edge of the underlying supporting surface, bed or table. A patient is then presented onto the device lying with her back on the top surface 12 or, if present, the removeably attached cushion 17 as in FIG. 7. A portion of her body may also be supported by the underlying supporting surface, table or bed. Her vulva or pelvic floor is aligned with the upper edge of the front surface 15, and presents above the semispherical concave well 16, if present as in FIG. 7, to create a theater within which the examiner may conduct an examination, manipulate tools and observe the anatomy. Throughout the examination, the feet are placed and remain on the underlying supporting surface, bed or table with the legs in an abducted position. Knees are apart from each other in order to maximize access and visibility for the examiner. With the patient presented atop the device, the examiner then may conduct a pelvic exam or other procedure. When the examination is done, the patient dismounts the device; the examiner removes and transports the device to the next area of use or storage.

In further detail, still referring to the invention of FIG. 5 to FIG. 7, the dimensions of the top surface 12 of the device are sufficiently wide and long to comfortably support a patient reclining upon it. The dimensions of the top surface can be any size but is envisioned to be about 12 to 48 inches long along the longitudinal axis and 12 to 36 inches wide along a horizontal axis between more than one side surface 14. The top surface 12 and the removeably attached cushion 17, if present as in FIG. 7, comfortably supports the patient's pelvis and hips in a position aligned with the horizontal edge formed at a nexus between the front surface 15 and the top surface 12. The cushion 17 can be affixed to the top surface 12 of the prismatic base 11 by hook and loop tape, screws, clips, straps or any existing equivalent. The length of the top surface 12 is envisioned to be a length that maximizes portability of the device, and comfort and stability for the patient. An envisioned embodiment of the invention supports only the pelvis and hips of the patient, while other embodiments of the device may provide support along the entire spine of the patient.

The dimensions of the front surface 15, height and width, can be any measure, but preferably within the range of 1 inch to 36 inches. One embodiment of the invention has a front surface whose height is 10 inches, thereby lifting the patient's perineum, and hips 10 inches above the surface of the underlying supporting surface, table or bed.

The top surface 12 and bottom surface 13 of the prismatic base are angularly disposed to create an incline that maintains the patient in a dorsal or modified lithotomy position. This angle of incline depends on the dimensions of the top surface 12 and the front surface 15. The angle of incline can measure any degrees, but is preferably within a range of 0 to 90 degrees.

The construction details of the invention as shown in FIGS. 5 to 7 are that the prismatic base 11 may be made of plastic or any other rigid, strong yet lightweight material. The prismatic base 11 in the embodiments represented by FIG. 5 to FIG. 7 can be made of solid rigid foam, expanded plastic or any existing equivalent material. It is envisioned that the cushion 17 as in FIG. 7 may be made of rubberized foam or any other material that is flexible and is comfortable for the patient to present herself upon. It is preferable, but not a necessary feature, that the cushion 17 be covered in a non-porous and easily-cleaned material such as plastic or vinyl. Further the remaining components of the invention can be made of metal or any other rigid and strong material.

Figure 8:
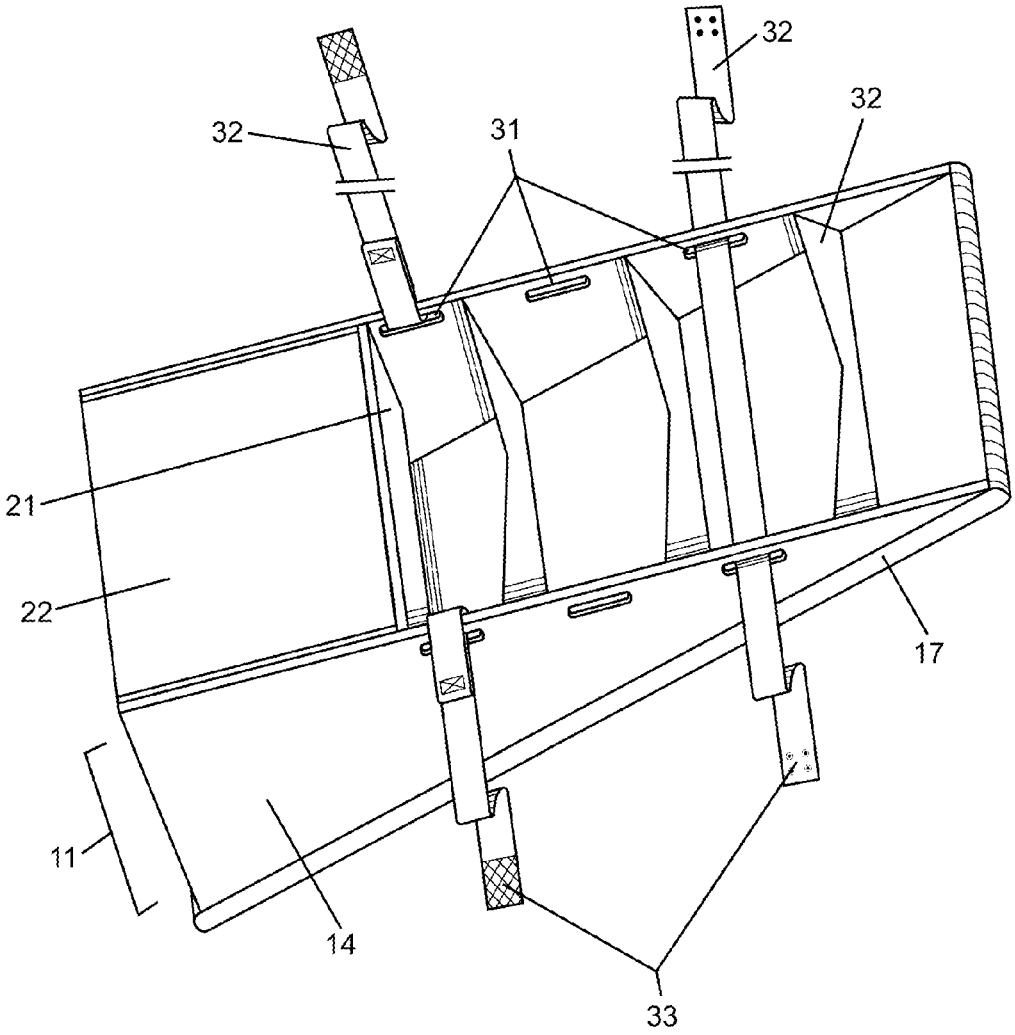
FIG. 8 is a bottom perspective view of an alternate embodiment of the device.

Referring now to the invention in FIG. 8 there is shown a portable lightweight pelvic exam device as in any of the aforementioned embodiments FIG. 1 to FIG. 7 further comprising a plurality of fenestrations 31 that receive an attaching means 32. The attaching means have distal ends whereon a fastening means 33 is attached. Furthermore, the embodiment in FIG. 8 comprises a plurality of support ribs 32 that run substantially perpendicular and along the underside of the top surface 12 and can connect from one side surface 14 of the prismatic base 11 to another side surface 14. The support ribs 32 act to provide lightweight support for the patient and strength throughout the device.

In more detail, still referring to the invention of FIG. 8, the fenestrations 31 can exist in any number, preferably at least two, one on each side surface 14 and oriented opposite and directly across from another fenestration 31. The fenestrations 31 can be oblong or rectangular perforations in the material comprising the prismatic base 11. The fenestrations receive the attaching means 32. The attaching means either pass through the fenestrations from one side surface 14 of the prismatic base 11 to another side surface 14, or can be individually affixed to a fenestration 31.

To conduct an examination wherein the attaching means 32 are utilized, the device is transported to an examining room or area. The device is placed on an existing supporting surface, for example a bed or table. The attaching means, which can be straps, are draped to either side of the device and allowed to hang over the edges of the supporting surface, bed or table. The distal ends of the attaching means 32, which are now hanging towards the floor of the environment, are now brought together by the examiner. The examiner fastens the attaching means 32 tightly around underside the supporting surface, bed or table. This step semi-permanently attaches the device to the surface and eliminates the likelihood of moving or sliding during the procedure. The front surface 15 of the device is aligned substantially near and parallel to an edge of the underlying supporting surface, bed or table. A patient is then presented onto the device lying with her back on the top surface 12 or if present the removeably attached cushion 17 as in FIG. 1. The examination proceeds as described in the description of the aforementioned embodiments. When the examination is done, the patient dismounts the device; the examiner removes the attaching means 32 and device from the support surface and transports the device to the next area of use or storage.

In further detail, still referring to the invention of FIG. 8, the dimensions of the attaching means are sufficiently wide and long to stably attach the device to an existing support surface in the environment. The attaching means 32, which can be straps, cords, ropes, vinyl belts, chains or any existing equivalent can be any length but preferably at least three times the width of the accompanying portable pelvic exam device. A length that can safely wrap around bottom of the support surface, bed or table is preferred. Fastening means 33 are attached onto the distal ends of the attaching means 32. The fastening means can be hook and loop tape, snaps, buttons, magnets or any existing equivalent.

The previously described versions of the present invention have many advantages, including and without limitation, the properties of being i) light-weight, ii) easily transportable by one person to the patient, iii) can be used on existing beds or tables, iv) is adapted to house necessary tools for examination procedures, v) requires little or no assembly prior to use and vi) is comfortable and safe for the patient. The device of the present invention is believed to accomplish all of the foregoing objectives. The invention does not require that all the advantageous features and all the advantages need to be incorporated into every embodiment of the invention.

Although the present invention has been described in considerable detail with reference to certain preferred versions thereof, other versions are possible. Therefore the spirit and scope of the appended claims should not be limited to the description of the preferred versions contained therein.

The reader's attention is directed to all papers and documents which are filed concurrently with this specification and which are open to public inspection with this specification, and the contents of all such papers and documents are incorporated herein by reference.

All the features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. As for "means for" elements, the applicant intends to encompass within the language any structure presently existing or developed in the future that performs the same function. The invention should therefore not be limited by the above described embodiment, method, and examples, but by all embodiments and methods within the scope and spirit of the invention.

What is claimed is:

1. A portable pelvic exam device which comprises a. a substantially wedge shaped prismatic base defined by a top surface, a bottom surface, a plurality of side surfaces extending upwards from the bottom surface, and a front surface, wherein the top surface and bottom surface are angularly disposed to create an incline that supports a patient in a dorsal or modified lithotomy position;

b. a semispherical concave well located approximately in the center of an edge formed at the nexus of the top surface and the front surface of the base and is defined by edges of a curve cut into the top surface and the front surface of the prismatic base c. a cushion demountably attached to the top surface of the prismatic base;

d. a drawer comprising a face plate, a plurality of side walls, a back wall and a floor, and having a plurality of interior compartments as defined by a plurality of dividers, a handle attached to the face plate, and a lock to keep the drawer closed while being transported or used, wherein the drawer is retractably mounted on a pair of rails into an aperature in the front surface of prismatic base, and is arranged to be withdrawn from front surface of prismatic base by user exerting a pulling force and inserted by user exerting a pushing force; and e. a pair of removable stirrup assemblies pivotally mounted to the side walls of the prismatic base by a plurality of receiving adapters for mated fitting with stirrup assemblies.

2. A portable pelvic exam device which comprises a substantially wedge shaped prismatic base defined by a top surface, a bottom surface, a plurality of side surfaces extending upwards from the bottom surface, and a front surface, wherein the top surface and bottom surface are angularly disposed to create an incline that supports a patient in a dorsal or modified lithotomy position, a pair of removable stirrup assemblies pivotally mounted to the side walls of the prismatic base by a plurality of receiving adapters for mated fitting with the stirrup assemblies, and a semispherical concave well located approximately in the center of an edge formed at the nexus of the top surface and the front surface of the base and is defined by edges of a curve cut into the top surface and the front surface of the prismatic base, wherein a patient's perineum is aligned and flush with the front surface of the device and wherein the patient's perineum can be presented above the semispherical concave well which creates a theatre for a practitioner to conduct an examination.

3. The device as in claim 2, further comprising a cushion demountably attached to the top surface of the prismatic base, wherein the semispherical concave well is defined also by edges of a curve cut into the cushion.

4. The device as in claim 2, further comprising a drawer.

5. The device as in claim 4, wherein the drawer further comprises a face plate, a plurality of side walls, a back wall and a floor.

6. The device as in claim 4, wherein the drawer is retractably mounted into an aperture in the front surface of the prismatic base.

7. The device as in claim 4, wherein the drawer is mounted on rails to the prismatic base.

8. The device as in claim 4, wherein the drawer is arranged to be withdrawn from the front side surface of prismatic base by a user exerting a pulling force and inserted by the user exerting a pushing force.

9. The device as in claim 4, wherein the drawer has a plurality of interior compartments as defined by a plurality of dividers.

10. The device as in claim 4, wherein the drawer has a handle attached to the face plate.

11. The device as in claim 4, wherein the drawer has a lock to keep the drawer closed while device is being moved or used.

12. The device as in claim 2, further comprising a plurality of receiving adapters attached to the prismatic base for mated fitting with ancillary tools.

13. The device as in claim 2, further comprising a pair of stirrup assemblies attached to the prismatic base.

14. The device as in claim 1, further comprising a means to attach the device to the environment.

15. The device as in claim 14, further comprising a plurality of fenestrations to receive the attaching means.

16. The device as in claim 14, wherein the attaching means is a plurality of straps, each having a distal end.

17. The device as in claim 16, further comprising a fastening means attached to the distal end of the straps.

18. The device as in claim 17, wherein the fastening means are snaps.

19. The device as in claim 17, wherein the fastening means are hook and loop tape.

20. The device as in claim 1, further comprising a plurality of support ribs running substantially perpendicular to the underside of the top surface to provide support for the top surface.

21. The device as in claim 1, wherein the prismatic base is made of lightweight and strong material such as plastic.

22. The device as in claim 1, wherein the cushion is covered in an impermeable and easily cleaned material such as vinyl or rubber.

23. A method of performing a pelvic exam using a portable pelvic exam device of claim 2 which comprises:

a. transporting the device to the environment within which an exam is to be performed;

b1. placing the device on a stable surface;

b2. aligning a front surface of the device to be substantially parallel and close to an edge of the stable surface;

c. presenting a patient to be examined;

d. instructing the patient to mount the device and stable surface so as to substantially align the patient's pelvic floor with the front surface of the device and above a semispherical concave well in a dorsal or modified lithotic position, wherein the patient's perineum is flush with the front surface of the device and presents itself above the semispherical concave well formed at the nexus of a top surface and the front surface of the device so as to make an ample theatre for an examiner to conduct an indicated procedure;

e. positioning the examiner to face the pelvis and vulva of the patient, and front side of the device, whereby the indicated procedure can be performed and the anatomy observed; and f. performing the indicated examination or procedure.

24. The method of claim 23 further comprising, fastening the device to the environment by using a fastening means.

25. The method of claim 23, further comprising instructing the patient to place her feet on the stable surface with knees abducted.

26. The method of claim 23, wherein the device comprises stirrup assemblies and further comprising instructing the patient to place her feet into the stirrup assemblies with knees abducted.

27. The method of claim 23, wherein the device comprises a drawer and further comprising opening and closing the drawer as necessary to withdraw ancillary tools contained therein.

28. The device as in claim 1 wherein:

the top surface of the prismatic base has a length, perpendicular to the edge formed at the nexus of the top surface and the front surface, between 12 and 48 inches and has a width, parallel to the edge, between 12 and 36 inches; and the front surface of the prismatic base has a width, parallel to the edge, between 1 and 36 inches and has a height, perpendicular to the edge, of 10 inches.

29. The device as in claim 12 further comprising lights mated to the plurality of receiving adaptors.

* * * * *

UNITED STATES PATENT AND TRADEMARK OFFICE

CERTIFICATE OF CORRECTION

PATENT NO. : 8,875,327 B2
APPLICATION NO. : 13/049099
DATED : November 4, 2014
INVENTOR(S) : Gilley It is certified that error appears in the above-identified patent and that said Letters Patent is hereby corrected as shown below:

Title Page, Item (12) delete "Gilley et al." and insert --Gilley--.

Title Page, Item (75) Inventors, delete

"(75) Inventors: Pamela Gilley, Winter Garden, FL (US);
Antonio Gandia Tapia, Maitland, FL (US)

and insert

--(75) Inventor: Pamela Gilley, Winter Garden, FL (US)--.

Signed and Sealed this
Fifteenth Day of September, 2015

Michelle K. Lee

Michelle K. Lee
*Director of the United States Patent and Trademark Office*